United States Patent [19]

Frank et al.

[11] 4,002,360

[45] Jan. 11, 1977

[54] WINDOW HARDWARE

[75] Inventors: Gerhard Frank; Ernst Roth, both of Wilnsdorf-Obersdorf, Germany

[73] Assignee: Siegenia-Frank KG, Siegen, Germany

[22] Filed: Sept. 6, 1974

[21] Appl. No.: 503,975

[30] Foreign Application Priority Data

Sept. 8, 1973 Germany ..... 2345496

[52] U.S. Cl. ..... 292/336.3; 292/142; 292/172; 292/337; 292/DIG. 20

[51] Int. Cl.[2] ..... E05B 9/00; E05B 9/06; E05C 1/06; E05C 1/12

[58] Field of Search ..... 292/39, 142, 160, 172, 292/336.3, 337, 265

[56] References Cited

UNITED STATES PATENTS

| | | | |
|---|---|---|---|
| 321,380 | 6/1885 | Murphy | 292/172 |
| 2,491,701 | 12/1949 | Albritton | 292/337 X |
| 2,634,151 | 4/1953 | Russell et al. | 292/337 |
| 2,665,154 | 1/1954 | Hagstrom | 292/337 X |
| 2,862,750 | 12/1958 | Minke | 292/336.3 X |

FOREIGN PATENTS OR APPLICATIONS

| | | | |
|---|---|---|---|
| 247,741 | 6/1966 | Austria | 292/336.3 |
| 1,082,937 | 6/1954 | France | 292/39 |
| 1,950,153 | 6/1970 | Germany | 292/39 |
| 200,921 | 1/1966 | Sweden | 292/265 |

*Primary Examiner*—Paul R. Gilliam
*Assistant Examiner*—Carl F. Pietruszka
*Attorney, Agent, or Firm*—Norman S. Blodgett; Gerry A. Blodgett

[57] ABSTRACT

Window hardware for driving a latch rod, especially for insertion in the edge of casement windows, doors, etc., wherein the back side is fastened on a track, consisting of a drive housing having two housing parts in which is positioned a turnable member which can have the shape of a pinion, the turnable member engaging the latch rod fitting which extends through a guide canal in the drive housing and is guided and movable longitudinally on the inverted track.

6 Claims, 4 Drawing Figures

IV
II
III

WINDOW HARDWARE

BACKGROUND OF THE INVENTION

Window fittings for actuating drive rods have been described in German patents DT-GM No. 7,025,066 published Mar. 11, 1971 and DT-OS No. 2,033,042. Additionally, a special extended form of such driving rod fittings are sold under the designation "SIEGENIA-TRIAL-GETRIEBE".

In these known drive rod fittings, the drive housing consists of two housing parts which are designed and assembled in such a manner that they meet each other in a plane corresponding to the plance of the center of rotation of the turnable member. At least in the areas supporting the turnable member and for the guidance of the drive rod, the two housing parts are symmetrical and mirror images.

To make sure that in such a drive housing design the forces which appear during the operation of the drive rod fitting can be controlled, it is not only necessary to tighly connect the two housing parts in the direction of the axis of rotation of the turnable member, but both housing parts must also be connected to the inverted track, so that the tilting forces which act on the housing may be safely intercepted. Such tilting forces arise, for instance, when the support rosetta for the service handle of the driving rod fitting (connected to the housing conventionally by anchor bolts) is forcibly tightened. At that time the drive housing does not engage with its side surface the parallel side surfaces of a recess formed in the casement wings of windows and doors. This is always the case when such a driving rod fitting must be inserted into windows and doors made of metal or plastic extrusions.

By directly fastening both housing parts of the drive-housing to the inverted track, the two housing halves are first connected with the driving housing during mounting after attachment of driving rod and the pinion. Only then may the drive housing be fastened to the inverted track. This fastening of the drive housing to the inverted track is done by a riveting operation because with a welding operation such as spot welding, the possibility exists that the movable driving members, enclosed within the drive housing, could back tightly onto the housing parts, as consequence of electrical shut-offs and not be turnable at all, or only with considerable difficulty.

German patent DT-GM No. 7,127,215 published on Sept. 30, 1971 teaches the use of a space for the drive housing of such drive rod fittings whereby the housing part can be welded before the mounting of the drive on the inverted track. The possibility of welding is attained at the cost of other disadvantages. For example, one important disadvantage is that the drive housing has to be put together from two housing parts in which the separating plane practically runs parallel to the inverted plane. In this design of the drive housing, the pinion is supported only in one housing part and the drive rod is guided only in the other housing part. Due to this design, the radial force-components, which appear during the transfer of motion between the pinion and the driving rod are not absorbed by the housing itself, but act on the connecting media of the housing, namely on the rivets or bolts.

Another disadvantage of the conventional drive design is that the pinion which serves as a driving member is not equipped with supports on which the housing may be supported. However, it is supported with its tooth circumference lying against a corresponding arcuate wall of one of the housing parts. In this method, considerable friction forces have to be overcome which makes the drive difficult to operate and, after a short working period, wear shows up caused by the friction of the pinion teeth on the support wall of the housing.

In this known design of drive housing for drive rod fittings a considerable reduction of the durability is accepted in favor of production simplification. These and other difficulties experienced with the prior art devices have been obviated in a novel manner by the present invention.

It is, therefore, an outstanding object of the invention to provide window hardware which eliminates the above-mentioned deficiencies of the known design of drive housings for drive rod fittings, but at the same time makes use of their advantages.

Another object of this invention is the provision of a drive-rod fitting of the previously-described type in which one housing part of the drive housing can be tightly connected to the track before mounting, but in which, in spite of this, the reaction forces which act during the operation of the drive between the turnable member and the driving rod engaged to it are directly absorbed by the housing parts of the drive housing, so that the connection between the two housing parts is relieved from these reaction forces.

A further object of the present invention is the provision of window hardware in which rivet connections between the drive housing and the inverted track are avoided.

With these and other objects in view, as will be apparent to those skilled in the art, the invention resides in the combination of parts set forth in the specification and covered by the claims appended hereto.

SUMMARY OF THE INVENTION

In general, the invention consists of forming the housing in two parts, i.e., one housing part of U-shaped cross-section and another housing part of L-shaped cross-section, defining between them a guide channel in which the drive rod slides. The use of additional means that is independent of the housing parts for the force-absorbing connection of the drive housing is avoided in a simple way by using lugs and apertures. It has been found to be of special advantage for safeguarding the reciprocal engagement of the force-accepting connecting means to make them integral with the two housing parts. With reference to the design and mounting ability, the characteristics of using sheet metal stampings and welding to the track were of advantage, because on one hand it makes it possible to create an inexpensive design of the drive housing and on the other hand guarantees a rivet-free and consequently inconspicuous connection of the drive housing with the inverted track.

A safe connection of the two housing parts of the driving housing has been found to be obtained advantageously by the use of coupling members incorporating the transfer forces of the drives between the housing parts, in the area of the support of the pinion, and in the area of the attachment of anchor bolts for fastening the support rosetta of the service handle by the use of the spacing members with threaded sleeves. Finally, it is recommended, especially for simplification of the drive housing design, that the L-shaped housing part be integrally formed with the spacing members, because all elements are integrated in that way to effect a proper connection for the drive housing.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figures 1, 2, 3, 4:
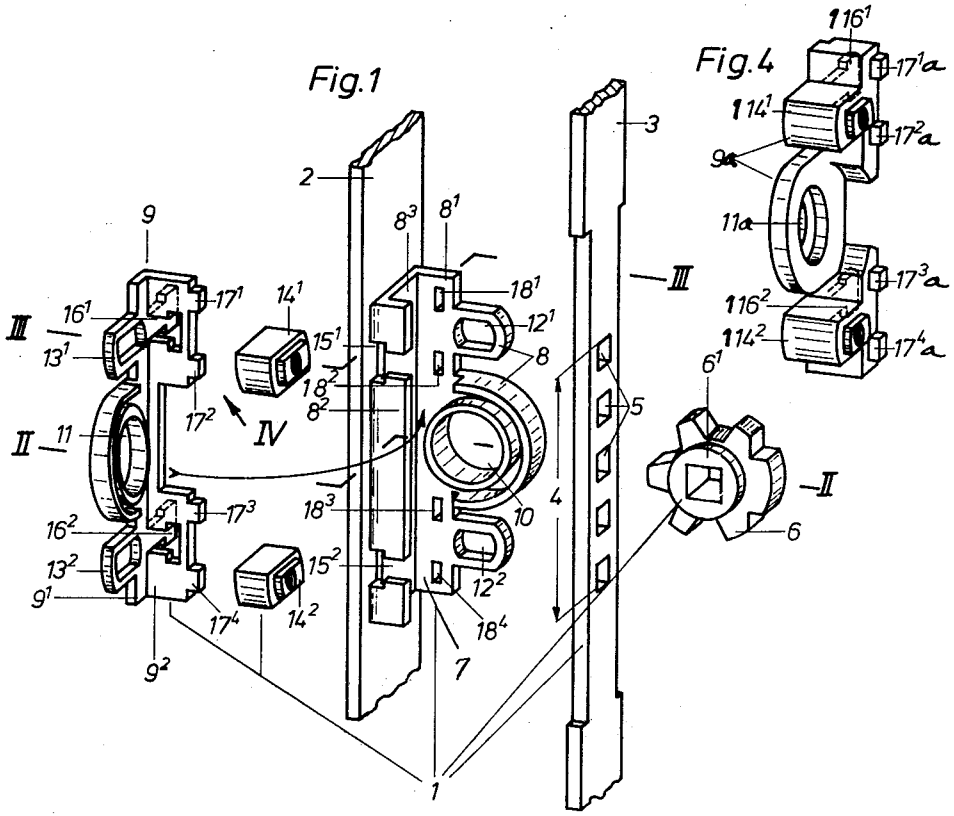
FIG. 1 is an exploded perspective view of a preferable design form of a drive for driving rod fittings built in accordance with this invention, whereby one of the housing parts of the drive housing is swung out of the normal position by 90° for a better view.
FIG. 2 is a sectional view taken on line II—II of FIG. 1 through the assembled drive.
FIG. 3 is a sectional view taken on the line III—III of FIG. 1 through the assembled drive.
FIG. 4 is a perspective view of a modified form of one of the parts.

FIG. 1 of the drawing shows a complete operating drive 1 for driving rod fittings having the design of an edge-insertable drive with all its details. It is equipped with an inverted track 2 and a driving rod 3 arranged behind it and longitudinally displacable. This driving rod 3 is equipped in a predetermined portion 4 of its length with a gear rack 5 for engaging a pinion 6. The pinion 6 is turnably supported within a drive housing 7 through which the drive rod 3 with the gear rack area 4 and holes 5 also passes. This drive housing 7 is formed as the two housing parts 8 and 9, the housing part 8 being fastened by welding (especially spot welding) to the back side of the track 2 before the whole edge-inserted drive is mounted. By this mounting, the drive rack 3 and the pinion 6 are carefully inserted into housing part 8 and afterward the housing part 9 is placed on top of it and is securely fastened to the housing part 8, the closure of the drive housing 7 forming the functional edge-insertable drive 1.

The housing part 8 of the drive housing 7 has a generally U-shaped cross-section and is fastened to the inverted track 2 in such a way that the two free legs $8^1$ and $8^2$ with the connecting leg $8^3$ are placed on the backside of the inverted track 2 and extending parallel to the track length. In this way the two free legs $8^1$ and $8^2$ of the housing part 8 lie at right angles to the track plane and away from the backside of the inverted track 2.

The housing part 9 has a generally L-shaped cross-section and has two legs $9^1$ and $9^2$ which are arranged at a right angle to each other. The length of the leg $9^1$ is dimensioned in such a way that it corresponds to the length of the leg $8^1$ of housing part 8 reduced by the length of leg $8^2$. The length of leg $9^2$ of the housing part 9 is on one hand related to the length of leg $8^3$ of the housing 8 in such a way that the leg may bridge the distance between the two legs $8^1$ and $8^2$ of the housing part 8. During assembly of the housing part 9, it is positioned on the housing part 8 of the leg $9^1$ in the same plane as the leg $8^2$. The areas of the legs $8^1$ and $9^1$ of both housing parts 8 and 9 are guided together in mirror symmetry with the housing 7 above the legs $9^2$.That is to say, in the design shown, both housing parts 8 and 9 have (on the one hand) facing support surfaces 10, 11 for collars $6^1$ and $6^2$ of the pinion 6 and (on the other hand) they are equipped with attached mounting extensions $12^1$, $12^2$, $13^1$, $13^2$ for the fastening of threaded sleeves $14^1$ and $14^2$ for the anchor bolts of the support rosetta of the service handle.

Furthermore, as can be seen in FIG. 1, the shorter leg $8^2$ of the housing part 8 is equipped with two cutouts at its free end, which cutouts $15^1$ and $15^2$ open toward the front edge. These cutouts $15^1$ and $15^2$ are T-shaped and the two legs face in the same direction toward the border of the track 2. The lugs $15^1$ and $15^2$ are, therefore, equipped with cutouts which face away from the free end.

It also can be seen in FIG. 1 that the housing part 9 contains two lugs $16^1$ and $16^2$ of T-shape which lie in the plane of the leg $9^1$ and extends from the underside of the leg $9^2$. The two legs of the T-shaped lugs which extend in the same plane, are positioned hereby on the free lug end and the lugs $16^1$ and $16^2$ have their dimensions selected to fit in the recesses $15^1$ and $15^2$ of the housing part 8.

By mounting the two housing parts 8 and 9 to form the driving housing 7, the lugs $16^1$ and $16^2$ engage the recesses $15^1$ and $15^2$ from the side and so create a form-locked connection between the two housing parts 8 and 9 in the direction perpendicular to the inverted track plane 2 as well as parallel to the longitudinal direction of the track 2. According to FIG. 1, the leg $9^2$ of the housing part 9 has on its free end several extensions $17^1$ to $17^4$ with which corresponding fitted openings are provided on the leg $8^1$ of the housing part 8 in its transverse direction. During the mounting of the two housing parts 8 and 9 of the driving housing 7, extensions $17^1$ to $17^4$ enter the openings $18^1$ to $18^4$ and penetrate far enough so that they extend somewhat to the outside of the leg $8^1$. The possibility exists of upsetting the extensions $17^1$ to $17^4$ so that the two housing parts 8 and 9 are held together in the direction of rotation of the pinion 6.

Simply by integral connections formed in both housing parts 8 and 9, the drive housing 7 is safely held together in all three directions. Simply for added safe holding of the two housing parts 8 and 9 against each other, threaded sleeves $14^1$ and $14^2$ with the engaging lugs $12^1$ and $12^2$, $13^1$ and $13^2$ can be tightly upset. This procedure is purposely accomplished in such a way that the upsetting of the threaded sleeves $14^1$ and $14^2$ takes place first with the housing part 9, before it is united with the housing part 8. It is, therefore, possible to connect the threaded sleeves $14^1$ and $14^2$ with the engaging lugs $12^1$ and $12^2$ of the housing part 8 at the same time as the upsetting of the extensions $17^1$ to $17^4$ on this housing part; with this working operation the edge-inserted drive 1 in the vicinity of the main drive can be completed.

FIG. 3 of the drawing makes it especially clear that, after the connection of the two housing parts 8 and 9 of the drive housing 7, a guide channel 19 is created for the driving rod 3 which channel is at least partially closed on all sides. This channel is formed on three sides by the legs $8^1$ to $8^3$ of the housing part 8, and the fourth side is defined by the leg $9^2$ of the housing part 9.

It should be recognized that by use of the previously-described design of the driving housing 7, the reaction forces which are created by operating of the drive between pinion 6 and the drive rod 3 are directly absorbed by the two housing parts 8 and 9 by omitting any intermediate connections and, consequently, constant, easy working of the edge-inserted drive is obtained. In the previously-described design of the drive housing 7, it is natural to stamp not only the housing part 8 from sheet metal, but in a corresponding way to make the housing part 9 also as a sheet-metal stamping. In this case, the cut-back lugs $16^1$ and $16^2$ can be made in such a way that they are cut from the material of the leg $9^2$ before the bending; after the bending of the leg, this separated material will stay in the same plane as the leg $9^1$.

In FIG. 4 of the drawing can now be seen that a housing part 9a can be made as a molded part from press cast or a similar injection material. In this case, a special advantage would be that the threaded sleeves $114^1$ and $114^2$ can be molded integral with the housing part 7 and no special riveting operation on the housing part 9 is required.

Naturally, this invention is not restricted to drive housings with the characteristic shape shown in the drawing, where its special characteristic consists of the fact that it may be inserted into groups of three bores, making a groove recess on the window casement. This invention can also be used in such drive housings as must be inserted in a conventional milled groove recess.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Window hardware, comprising a. a housing consisting of two interconnected parts forming a guide channel, one of the said parts of the housing having a generally U-shaped cross-section and the other part of the housing having an L-shaped cross-section.

b. a track on which the housing is fastened, c. a pinion supported in the housing, and d. a drive rod slidably carried in the guide channel of the housing for driving engagement with the pinion, the two said parts of the housing being of different cross-sectional heights and being also mountable together, so that first legs are positioned parallel to and adjacent to the track to form a guide channel for the drive rod, while secondary legs are positioned at right angles to the plane of the track and parallel to each other to act as supports for the pinion which is located in both parts of the housing.

2. Window hardware as recited in claim 1, characterized by the fact that the U-shaped part has a short leg directed at a right angle to the plane of the track and contains several cutouts which are open to the outside and the L-shaped part is equipped with cut back lugs on the leg that is positioned parallel to the plane of the track and in the plane of its extension which interlock with the recesses on the leg of the U-shaped housing part.

3. Window hardware as recited in claim 2, characterized by the fact that the long leg of the U-shaped housing part is directed at a right angle to the plane of the track is equipped with apertures which are located in the plane of the end of the short leg and which receives lugs having the same cross-section located on the free end of the leg of the L-shaped housing part and directed parallel to the track.

4. Window hardware as recited in claim 3, characterized by the fact that the L-shaped housing part is formed of sheet-metal and is welded to the track.

5. Window hardware as recited in claim 4, characterized by the fact that the two housing parts are connected by the engagement of the lugs with the openings to form the guide for the drive rod and are also connected by spacing members in the form of threaded sleeves positioned parallel to the track and to the axis of the pinion.

6. Window hardware as recited in claim 5, characterized by the fact the L-shaped housing part is formed as a molded part on which the spacing members are in the shape of integral plugs with threaded bores.

* * * * *